US012092104B2

(12) United States Patent
Teshima et al.

(10) Patent No.: US 12,092,104 B2
(45) Date of Patent: Sep. 17, 2024

(54) SCROLL COMPRESSOR WITH A THRUST PLATE AND A FLEXIBLE THRUST SHEET MEMBER

(71) Applicant: SANDEN CORPORATION, Isesaki (JP)

(72) Inventors: Atsuo Teshima, Isesaki (JP); Taizo Sato, Isesaki (JP); Hiroki Mashiyama, Isesaki (JP)

(73) Assignee: SANDEN CORPORATION, Isesaki (JP)

( * ) Notice: Subject to any disclaimer, the term of this patent is extended or adjusted under 35 U.S.C. 154(b) by 0 days.

(21) Appl. No.: 18/261,041

(22) PCT Filed: Dec. 17, 2021

(86) PCT No.: PCT/JP2021/046698
§ 371 (c)(1),
(2) Date: Jul. 11, 2023

(87) PCT Pub. No.: WO2022/158198
PCT Pub. Date: Jul. 28, 2022

(65) Prior Publication Data

US 2024/0060494 A1 Feb. 22, 2024

(30) Foreign Application Priority Data

Jan. 22, 2021 (JP) ..... 2021-008672

(51) Int. Cl.
*F04C 18/02* (2006.01)
*F01C 17/06* (2006.01)
(Continued)

(52) U.S. Cl.
CPC ..... *F04C 18/0215* (2013.01); *F04C 27/008* (2013.01); *F04C 29/0021* (2013.01);
(Continued)

(58) Field of Classification Search
CPC ..... F04C 18/0215; F04C 27/008; F04C 29/0021; F04C 29/0028; F04C 2240/80; F01C 17/06
See application file for complete search history.

(56) References Cited

U.S. PATENT DOCUMENTS 4,824,344 A * 4/1989 Kimura ..... F04C 29/0021 418/94
7,878,777 B2 * 2/2011 Iwanami ..... F04C 18/0215 384/123
(Continued)

FOREIGN PATENT DOCUMENTS

JP 05-312156 A 11/1993
JP 2008-248775 A 10/2008
(Continued)

OTHER PUBLICATIONS

Japan Patent Office, International Search Report issued in International Application No. PCT/JP2021/046698, mailed Feb. 22, 2022 (4 pages).

*Primary Examiner* — Mary A Davis
(74) *Attorney, Agent, or Firm* — Baker Botts L.L.P.

(57) ABSTRACT

To reduce surface pressure acting on a tip of a winding terminal portion of a spiral wall of an orbiting scroll in a scroll compressor. In a scroll compressor 10, a thrust plate 81 and a thrust sheet 82 capable of being elastically deformed are provided between an opposing surface 237 serving as a thrust receiving part and an orbiting base plate 521 of an orbiting scroll 52. A first sealing member 83 seals between the orbiting base plate 521 and the thrust sheet 82 and a second sealing member 84 having a diameter greater than that of the first sealing member 83 seals the opposing surface 237 of a second partition wall 232 and the thrust plate 81. A back pressure chamber H5 is partitioned from a suction pressure area (space H6) by the thrust plate 81, thrust
(Continued)

sheet 82, the first sealing member 83, and the second sealing member 84. A circular concave portion 816 is formed on a surface of the thrust plate 81 on the thrust sheet 82 side.

10 Claims, 5 Drawing Sheets

(51) Int. Cl.
*F04C 23/00* (2006.01)
*F04C 27/00* (2006.01)
*F04C 29/00* (2006.01)

(52) U.S. Cl.
CPC ..... *F04C 29/0028* (2013.01); *F01C 17/06* (2013.01); *F04C 23/008* (2013.01); *F04C 2240/80* (2013.01)

(56) References Cited

U.S. PATENT DOCUMENTS

| | | | | |
|---|---|---|---|---|
| 11,933,298 | B2 * | 3/2024 | Teshima ..... | F04C 18/0215 |
| 2013/0259726 | A1 | 10/2013 | Yamashita et al. | |
| 2020/0102956 | A1 | 4/2020 | Seong et al. | |
| 2023/0296131 | A1 * | 9/2023 | Suzuki ..... | F04C 18/0215 384/292 |

FOREIGN PATENT DOCUMENTS

| | | | |
|---|---|---|---|
| JP | 2013-204457 | A | 10/2013 |
| JP | 2020-153295 | A | 9/2020 |

* cited by examiner

SCROLL COMPRESSOR WITH A THRUST PLATE AND A FLEXIBLE THRUST SHEET MEMBER

CROSS-REFERENCE TO RELATED APPLICATIONS

This application is a U.S. National Stage Patent Application under 37 U.S.C. § 371 of International Patent Application No. PCT/JP2021/046698, filed on Dec. 17, 2021, which claims the benefit of Japanese Patent Application No. JP 2021-008672, filed on Jan. 22, 2021, the disclosures of each of which are incorporated herein by reference in their entirety.

TECHNICAL FIELD

The present invention relates to a scroll compressor.

BACKGROUND ART

A scroll compressor includes a fixed scroll and an orbiting scroll that are arranged such that spiral walls of the fixed and orbiting scrolls mesh with each other. In the scroll compressor, the volume of a compression chamber formed between the spiral walls changes when the orbiting scroll orbits (revolves) with respect to the fixed scroll, and as a result, a fluid taken into the compression chamber is compressed. An example of this type of scroll compressor is disclosed in Patent Document 1.

FIG. 5 is a cross-sectional view illustrating an example of a scroll compressor disclosed in Patent Document 1. In the scroll compressor disclosed in Patent Document 1, on a back surface side of a base plate (mirror plate) 31 of an orbiting scroll (movable scroll) 22, a back pressure chamber 39 that causes a back pressure load that presses the orbiting scroll 22 against the fixed scroll 21 is formed. The back pressure chamber 39 is partitioned from a suction portion 37, which is a suction pressure area, by an annular thrust plate 38 that is provided between a frame portion 7B of a compression mechanism housing 7 and the orbiting scroll 22 (i.e., back surface side of the orbiting scroll 22), an annular first sealing member 41 that is attached to the back surface of the base plate 31 of the orbiting scroll 22 and abuts against one surface of the thrust plate 38, and an annular second sealing member 42 that is attached to the thrust plate 38 side surface of the frame portion 7B, abuts against the other surface of the thrust plate 38, and has a diameter greater than that of the first sealing member 41.

REFERENCE DOCUMENT LIST

Patent Document

Patent Document 1: JP 2020-153295 A

SUMMARY OF THE INVENTION

Problem to be Solved by the Invention

In the scroll compressor disclosed in Patent Document 1, a turning moment that causes the orbiting scroll 22 to tilt acts on the orbiting scroll 22 due to a centrifugal force generated by orbiting (revolving) motion of the orbiting scroll 22. In addition, in the scroll compressor disclosed in Patent Document 1, as shown with hatching in FIG. 6, the back pressure load that presses the orbiting scroll 22 against the fixed scroll

21 acts on a portion radially inside the second sealing member 42 and radially outside the first sealing member 41 on the other surface of the thrust plate 38, when the thrust plate 38 is viewed from the axial direction of a drive shaft (rotating shaft) 14. That is, the back pressure load biasedly acts on the orbiting scroll 22. Thus, a turning moment due to the biased back pressure load as well as the turning moment due to the centrifugal force acts on the orbiting scroll 22.

When the orbiting scroll 22 tilts, a tip of a spiral wall (wrap) 31 of the orbiting scroll 22 only partially contacts the base plate (mirror plate) 23 of the fixed scroll 21 and a spiral wall (wrap) 24 of the fixed scroll 21 only partially contacts the base plate (mirror plate) 31 of the orbiting scroll 22. A contact force concentrates particularly on the tip of the winding terminal portion of the spiral wall 31 of the orbiting scroll 22 and the winding terminal portion of the spiral wall 31 of the orbiting scroll 22 is formed to be thinnest in the spiral wall (wrap). Thus, when the orbiting scroll 22 tilts, a high surface pressure acts on the tip of the winding terminal portion of the spiral wall of the orbiting scroll 22.

In recent years, there have been demands for increase in efficiency and reduction in size and weight of scroll compressors. As the efficiency of a scroll compressor is increased and the size and weight of the scroll compressor is reduced, the surface pressure acting on a tip of a winding terminal portion of a spiral wall of an orbiting scroll increases due to tilting of the orbiting scroll. As a result, wear or damage of the tip of the winding terminal portion of the wrap of the orbiting scroll may occur.

An object of the present invention is thus to provide a scroll compressor capable of reducing surface pressure acting on a tip of a winding terminal portion of a spiral wall of an orbiting scroll, thereby suppressing wear and damage of the tip of the winding terminal portion of the spiral wall of the orbiting scroll.

Means for Solving the Problem

According to an aspect of the present invention, a scroll compressor is provided. The scroll compressor includes a drives shaft; a fixed scroll including a fixed base plate and a fixed spiral wall erected on the fixed base plate; and an orbiting scroll including an orbiting base plate and an orbiting spiral wall that is erected on the orbiting base plate and meshes with the fixed spiral wall. The scroll compressor is configured such that the volume of a compression chamber formed between the fixed scroll and the orbiting scroll changes and a fluid taken into the compression chamber is thereby compressed when the orbiting scroll orbits with respect to the fixed scroll along with a rotation of the drive shaft. The scroll compressor includes an annular plate member that is provided on a back surface side of the orbiting base plate of the orbiting scroll and has a diameter greater than a diameter of the orbiting scroll; an annular sheet member that is provided between the back surface of the orbiting base plate of the orbiting scroll and the plate member, has a diameter substantially equal to the diameter of the plate member, and is capable of being elastically deformed; an annular first sealing member attached to a peripheral edge of the back surface of the orbiting base plate of the orbiting scroll, of which a tip slidably contacts the sheet member; a thrust receiving part that receives, via the sheet member and the plate member, a thrust load that acts on the orbiting scroll due to a compression reaction force; an annular second sealing member that is formed to have a diameter greater than a diameter of the first sealing member, attached to one of a surface of the plate member on the thrust receiving part side and the thrust receiving part, and of which a tip contacts the other one of the surface of the plate member on the thrust receiving part side and the thrust receiving part; and a back pressure chamber that is partitioned from a suction pressure area by the plate member, the sheet member, the first sealing member, and the second sealing member and applies a back pressure load that presses the orbiting scroll against the fixed scroll to the plate member and the orbiting scroll. A circular concave portion is formed on a surface of the plate member on the sheet member side.

Effects of the Invention

An aspect of the present invention makes it possible to provide a scroll compressor capable of reducing surface pressure acting on a tip of a winding terminal portion of a spiral wall of an orbiting scroll, thereby suppressing wear and damage of the tip of the winding terminal portion of the spiral wall of the orbiting scroll.

MODE FOR CARRYING OUT THE INVENTION

An embodiment of the present invention is described below with reference to the accompanying drawings.

Figure 1:
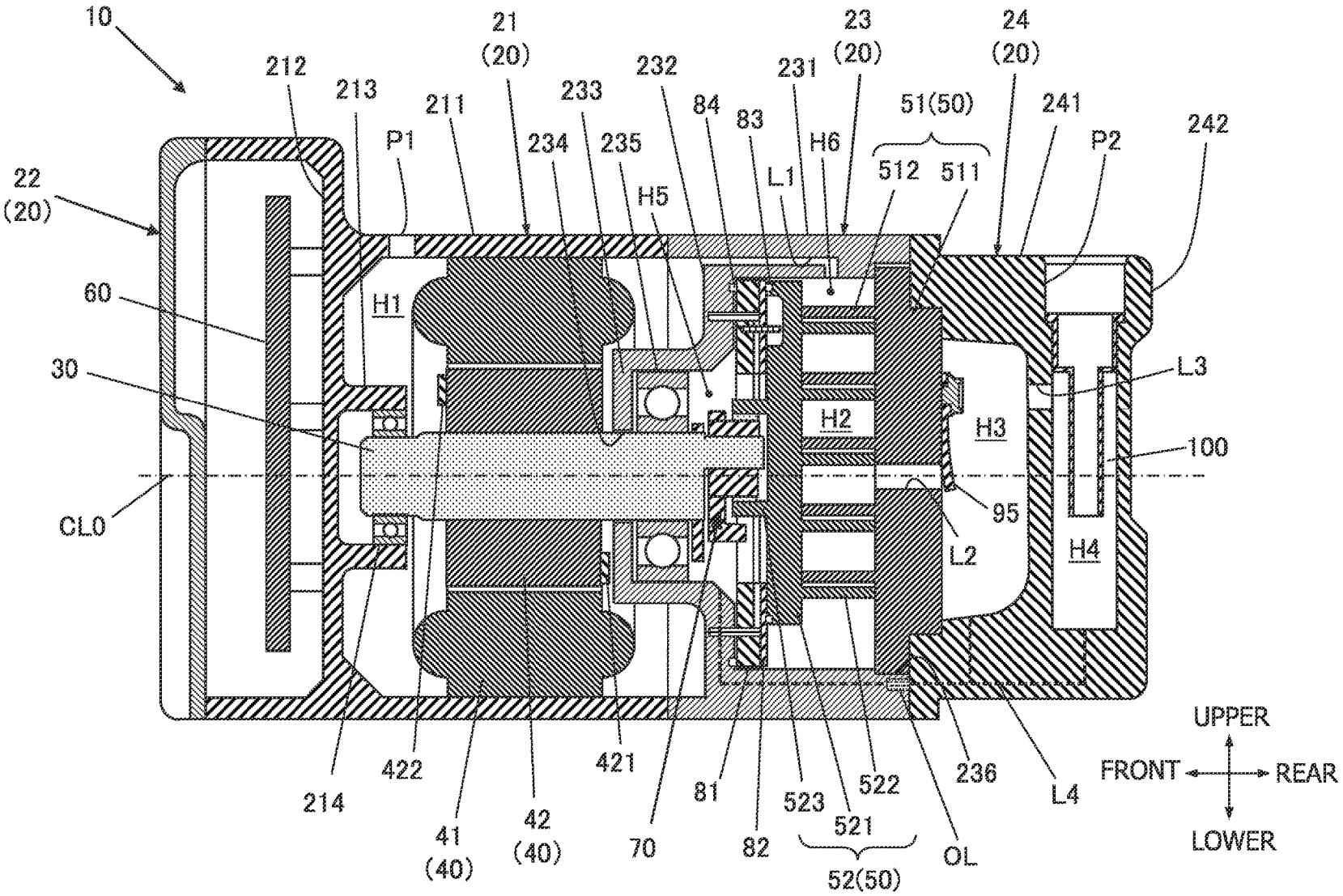
FIG. 1 is a cross-sectional view illustrating a schematic configuration of a scroll compressor according to an embodiment of the present invention.

FIG. 1 is a cross-sectional view illustrating a schematic configuration of a scroll compressor according to an embodiment of the present invention. A scroll compressor 10 according to an embodiment is incorporated, for example, into a refrigerant circuit of a vehicle air conditioner and is configured to compress a low-pressure gaseous refrigerant (fluid) received from the refrigerant circuit, and to send the resulting high-pressure gaseous refrigerant back into the refrigerant circuit. In FIG. 1, the left side corresponds to the front side of the scroll compressor 10, the right side corresponds to the rear side of the scroll compressor 10, the upper side corresponds to the upper side of the scroll compressor 10, and the lower side corresponds to the lower side of the scroll compressor 10.

The scroll compressor 10 includes a housing 20, a drive shaft 30, an electric motor 40 that rotates the drive shaft 30, a scroll unit 50 that is driven via the drive shaft 30 and compresses a (low-pressure) gaseous refrigerant, and an inverter 60 that drives and controls the electric motor 40. The drive shaft 30, the electric motor 40, the scroll unit 50, and the inverter 60 are stored in the housing 20. The scroll unit 50 includes a fixed scroll 51 and an orbiting scroll 52 that orbits with respect to the fixed scroll 51.

The housing 20 includes a front housing 21, a cover member 22, a center housing 23, and a rear housing 24. These components are fastened to each other, for example, with at least one fastening member (not shown) to form the housing 20 of the scroll compressor 10.

The front housing 21 includes a cylindrical shaped first peripheral wall 211 that extends in a front-rear direction and a first partition wall 212 that partitions the interior of the first peripheral wall 211 into front and rear spaces. The front end face of the first peripheral wall 211 forms the front end face of the front housing 21, and the rear end face of the first peripheral wall 211 forms the rear end face of the front housing 21. The interior of the first peripheral wall 211 (i.e., the internal space of the front housing 21) is partitioned by the first partition wall 212 into a front-side inverter storage space storing the inverter 60 and a rear-side motor storage space storing the electric motor 40. That is, in the present embodiment, the electric motor 40 and the inverter 60 are stored in the front housing 21.

The first partition wall 212 has a supporting portion 213 that supports the front end portion of the drive shaft 30. The supporting portion 213 is formed to protrude in a cylindrical shape into the motor storage space from the rear-side surface of the first partition wall 212. The supporting portion 213 is configured to rotatably support the front end portion of the drive shaft 30 via a first bearing 214 fitted inside the supporting portion 213.

The cover member 22 is joined to the front end face of the front housing 21, thereby closing the inverter storage space (or forming an inverter storage chamber). The front end face of the center housing 23 is joined to the rear end face of the front housing 21. Sealing members may be provided as necessary between the front housing 21 and the cover member 22 and between the front housing 21 and the center housing 23.

The center housing 23 includes a cylindrical shaped second peripheral wall 231 that extends in the front-rear direction and a second partition wall 232 that partitions the interior of the second peripheral wall 231 into front and rear spaces. The front end face of the second peripheral wall 231 forms the front end face of the center housing 23, and the rear end face of the second peripheral wall 231 forms the rear end face of the center housing 23. The interior of the second peripheral wall 231 (i.e., the internal space of the center housing 23) is partitioned by the second partition wall 232 into the front-side connection space that connects to the motor storage space of the front housing 21 and the rear-side scroll storage space that stores the scroll unit 50. That is, in the present embodiment, the scroll unit 50 is stored in the center housing 23.

The second partition wall 232 has a hollow projection portion 233 that protrudes toward the front housing 21 (motor storage space). The hollow projection portion 233 is provided radially in the middle of the second partition wall 232 to face the supporting portion 213 provided on the first partition wall 212 of the front housing 21. A shaft insertion hole 234 is formed on the top of the hollow protrusion 233 such that the inside and the outside of the hollow projection portion 233 communicate with each other. The drive shaft 30 is inserted into and passes through the shaft insertion hole 234. A second bearing 235 that rotatably supports the rear end portion of the drive shaft 30 is fitted in the hollow projection portion 233. That is, in the present embodiment, the drive shaft 30 extends in the housing 20 in the front-rear direction and is rotatably supported by the first bearing 214 provided at the front housing 21 side and the second bearing 235 provided at the center housing 23 side.

The front end face of the rear housing 24 is joined to the rear end face of the center housing 23. In the present embodiment, a recess 236, in which an outer edge (peripheral edge) of a fixed base plate 511 (described later) of the fixed scroll 51 constituting the scroll unit 50 is placed, is formed on the rear end face of the center housing 23, i.e., on the rear end face of the second peripheral wall 231. The outer edge (peripheral edge) of the fixed base plate 511 is placed in the recess 236 and is sandwiched between the center housing 23 and the rear housing 24. The fixed scroll 51 is thereby fixed, and a rear-side opening of the second peripheral wall 231 is closed by the fixed base plate 511 of the fixed scroll 51. A sealing member may be provided as necessary between the center housing 23 and the rear housing 24.

The rear housing 24 has a bottomed cylindrical shape and includes a cylindrical shaped third peripheral wall 241 that extends in the front-rear direction and a bottom wall 242 that closes the rear-side opening of the third peripheral wall 241. The front end face of the third peripheral wall 241 that forms the front end face of the rear housing 24 is joined to the rear end face of the second peripheral wall 231 that forms the rear end face of the center housing 23. A front-side opening of the third peripheral wall 241 is thereby closed by the fixed base plate 511 of the fixed scroll 51.

The electric motor 40 is implemented by, for example, a three-phase alternating current motor and includes a stator core unit 41 and a rotor 42.

The stator core unit 41 is fixed to an inner peripheral surface of the first peripheral wall 211 of the front housing 21. The inverter 60 converts a direct current from, for example, an on-board battery (not shown) into an alternating current, and supplies this alternating current to the stator core unit 41.

The rotor 42 is disposed radially inside of the stator core unit 41 with a predetermined gap therebetween. A permanent magnet is embedded in the rotor 42. The rotor 42 is formed in a cylindrical shape and has a hollow portion into which the drive shaft 30 is inserted. The rotor 42 is fixed to the drive shaft 30 with the drive shaft 30 being inserted in the hollow portion. That is, the rotor 42 is integrated with the drive shaft 30 and rotates together with the drive shaft 30.

When the inverter 60 supplies power to the electric motor 40 and a magnetic field is generated in the stator core unit 41, the rotor 42 is rotated by a rotational force applied to the permanent magnet of the rotor 42, and as a result, the drive shaft 30 rotates (or is driven to rotate).

As described above, the scroll unit 50 includes the fixed scroll 51 and the orbiting scroll 52 that orbits with respect to the fixed scroll 51.

The fixed scroll 51 has a disk-shaped fixed base plate 511 and a fixed spiral wall 512 erected on one surface of the fixed base plate 511. The fixed spiral wall 512 extends in a spiral shape (along an involute curve) on the one surface of the fixed base plate 511 from a radially inner end portion (winding start portion) to a radially outer end portion (winding terminal portion). The fixed scroll 51 is fixed in such a state that the one surface of the fixed base plate 511 (the surface on which the fixed spiral wall 512 is erected) faces forward and the outer edge of the fixed base plate 511 is placed in the recess 236 and is sandwiched between the center housing 23 and the rear housing 24.

The orbiting scroll 52 includes a disk-shaped orbiting base plate 521, an orbiting spiral wall 522 erected on one surface of the orbiting base plate 521, and a cylindrical portion 523 formed to protrude on the other surface of the orbiting base plate 521. The orbiting spiral wall 522 extends in a spiral shape (along an involute curve) on the one surface of the orbiting bas plate 521 from a radially inner end portion (winding start portion) to a radially outer end portion (winding terminal portion). The orbiting scroll 52 is disposed such that the orbiting spiral wall 522 engages with the fixed spiral wall 512 of the fixed scroll 51. That is, the orbiting scroll 52 is disposed between the second partition wall 232 of the center housing 23 and the fixed scroll 51 such that the one surface of the orbiting base plate 521 (the surface on which the orbiting spiral wall 522 is erected) faces backward. Hereinafter, the other surface of the orbiting base plate 521 (the surface on which the cylindrical portion 523 is formed) is referred to as a back surface of the orbiting base plate 521.

The orbiting scroll 52 is driven by a driving force transmitted via the drive shaft 30 and a crank mechanism 70. The driven orbiting scroll 52 is configured to orbit with respect to the fixed scroll 51 while being prevented from rotating. That is, the crank mechanism 70 is configured to couple the drive shaft 30 to the orbiting scroll 52 and convert the rotary motion of the drive shaft 30 into the orbiting motion of the orbiting scroll 52.

The scroll unit 50 is configured to draw and compress the low-pressure gaseous refrigerant by revolving the orbiting scroll 52 with respect to the fixed scroll 51.

Figure 2:
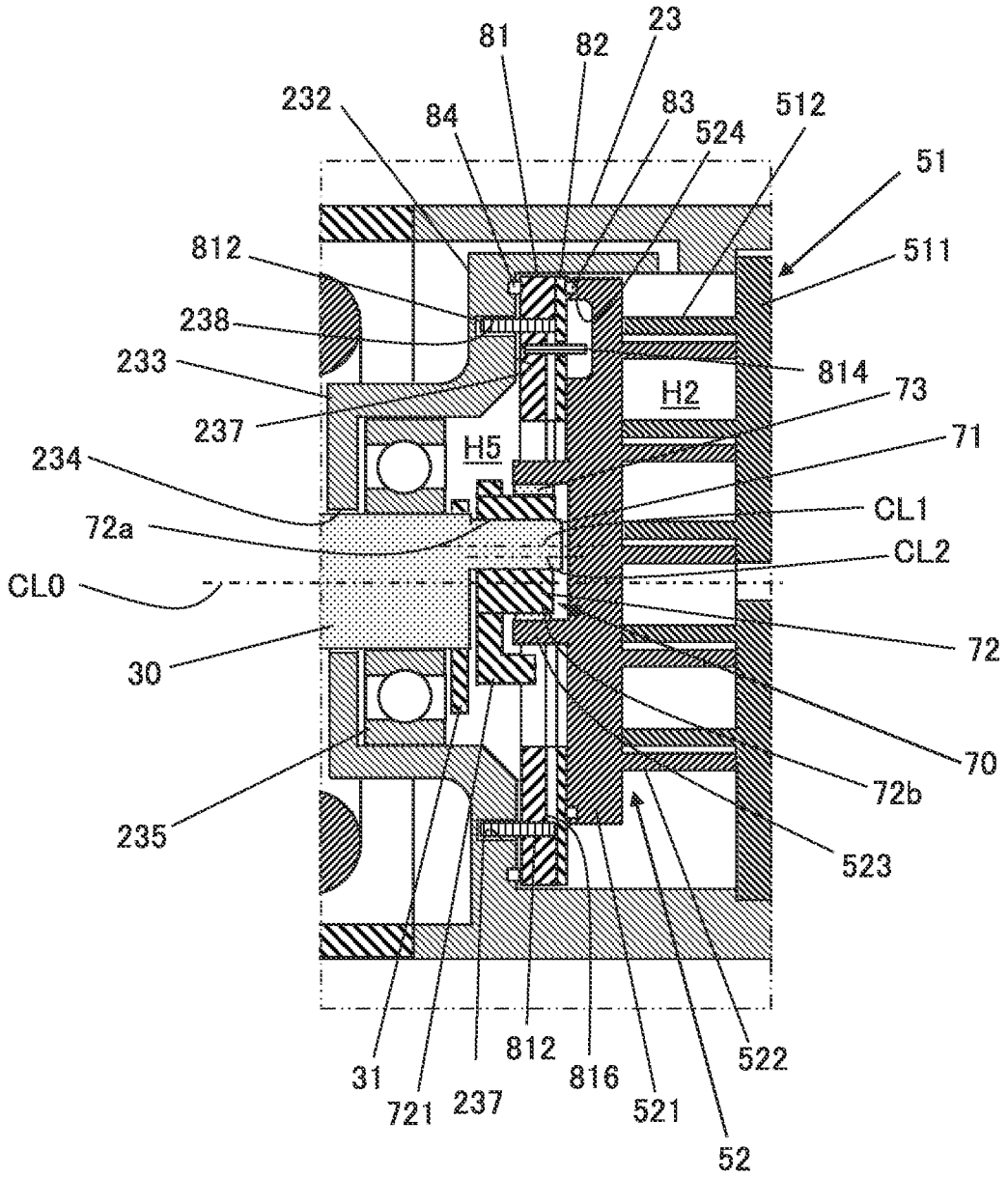
FIG. 2 is an enlarged view of a principal part of FIG. 1.

FIG. 2 is an enlarged view of a principal part of FIG. 1.

Referring to FIG. 2, the crank mechanism 70 includes an eccentric pin 71 provided at the rear end portion of the drive shaft 30 and an eccentric bush 72 attached to the eccentric pin 71.

The eccentric pin 71 extends from the rear end face of the drive shaft 30 in the axial direction of the drive shaft 30. The eccentric pin 71 is eccentric with respect to the drive shaft 30. That is, a centerline CL1 of the eccentric pin 71 is shifted from a centerline CL0 of the driver shaft 30.

The eccentric bush 72 is rotatably attached to the eccentric pin 71 and is rotatably inserted into the cylindrical portion 523 of the orbiting scroll 52 via a bearing 73. Specifically, the eccentric bush 72 is formed in a cylindrical shape. Also, a pin insertion hole 72*a*, into which the eccentric pin 71 is rotatably inserted, is formed in the eccentric bush 72. The pin insertion hole 72*a* is formed at a position eccentric from a centerline CL2 of the eccentric bush 72 and passes through the eccentric bush 72 in the axial direction. The eccentric pin 71 is inserted into the pin insertion hole 72*a* and the eccentric bush 72 is thereby rotatably attached to the eccentric pin 71. The centerline of the pin insertion hole 72*a* thus corresponds to the centerline CL1 of the eccentric pin 71. Moreover, an outer peripheral surface 72*b* of the eccentric bush 72 is supported by the bearing 73 attached to inside the cylindrical portion 523 of the orbiting scroll 52 and the eccentric bush 72 is thereby rotatably inserted into the cylindrical portion 523 of the orbiting scroll 52 via the bearing 73.

A bush balancer 721 that integrally rotates or swings with the eccentric bush 72 is fixed to the vicinity of the front end of the eccentric bush 72 (that is, near the end closer to the drive shaft 30), and a shaft balancer 31 that integrally rotates with the drive shaft 30 is fixed to the outer peripheral surface of the drive shaft 30 near the rear end of the drive shaft 30 (that is, near the end closer to the eccentric pin 71).

The bush balancer 721 counteracts the centrifugal force generated by the orbiting motion of the orbiting scroll 52 and mainly maintains proper pressing force of the orbiting spiral wall 522 against the fixed spiral wall 512. The bush balancer 721 and the shaft balancer 31 are provided for balancing across all movable components including the drive shaft 30 and components fixed or coupled to the drive shaft 30 by cooperating with rotor balancers 421, 422 (see FIG. 1) attached to the rotor 42.

The second partition wall 232 of the center housing 23 has an annular opposing surface 237 that is positioned radially outside the hollow projection portion 233 and faces the back surface of the orbiting base plate 521 of the orbiting scroll 52 with a space therebetween. A thrust plate (plate member) 81 and a thrust sheet (sheet member) 82 are provided in this order from the opposing surface 237 between the opposing surface 237 of the second partition wall 232 and the (back surface of the) orbiting base plate 521. In other words, the thrust plate 81 is provided on the back surface side of the orbiting base plate 521 and the thrust sheet 82 is provided between the thrust plate 81 and the (back surface of the) orbiting base plate 521.

The thrust plate 81 and the thrust sheet 82 are each formed in an annular shape and disposed radially outside the cylindrical portion 523 formed on the back surface of the orbiting base plate 521. Specifically, the thrust plate 81 has an outer diameter greater than that of the orbiting base plate 521 and has an inner diameter greater than an outer diameter of the cylindrical portion 523. The thrust sheet 82 is formed to have inner and outer diameters substantially equal to those of the thrust plate 81 (i.e., to have a diameter substantially equal to that of the thrust plate 81). The thrust plate 81 has a relatively high rigidity and is formed substantially so as not to bend. On the other hand, the thrust sheet 82 is flexibly made of thin metal plate having elasticity and is capable of being elastically deformed in the axial direction of the drive shaft 30.

An annular first sealing member 83 is provided between the back surface of the orbiting base plate 521 of the orbiting scroll 52 and the thrust sheet 82. The first sealing member 83 is made, for example, of synthetic resin having slidability. The first sealing member 83 is attached to a peripheral edge of the back surface of the orbiting base plate 521 of the orbiting scroll 52 so that the tip of the first sealing member 83 contacts the orbiting scroll 52 side surface of the thrust sheet 82. Specifically, in the present embodiment, the first sealing member 83 is inserted into an annular recess formed on the peripheral edge of the back surface of the orbiting base plate 521 of the orbiting scroll 52 such that the sealing member 83 partly protrudes from the back surface of the orbiting base plate 521 of the orbiting scroll 52. The tip of the protruding portion slidably contacts the orbiting scroll 52 side surface of the thrust sheet 82. During the orbiting motion of the orbiting scroll 52, the first sealing member 83 seals between the back surface of the orbiting base plate 521 of the orbiting scroll 52 and the thrust sheet 82 while sliding on the orbiting scroll 52 side surface of the thrust sheet 82.

An annular second sealing member 84 is provided between the opposing surface 237 of the second partition wall 232 and the thrust plate 81. The second sealing member 84 is made, for example, of synthetic rubber and has elasticity. The second sealing member 84 is formed to have a diameter greater than that of the first sealing member 83. Although not particularly limited to this, an O-ring, for example, may be used as the second sealing member 84. The second sealing member 84 is attached to one of the opposing surface 237 of the second partition wall 232 and the opposing surface 237 side surface of the thrust plate 81. The tip of the second sealing member 84 contacts the other one of them and seals between the opposing surface 237 of the second partition wall 232 and the thrust plate 81. Specifically, in the present embodiment, the second sealing member 84 is inserted into an annular recess formed on the opposing surface 237 of the second partition wall 232 such that the second sealing member 84 partly protrudes from the opposing surface 237 of the second partition wall 232. The tip of the protruding portion contacts the peripheral edge portion of the opposing surface 237 side surface of the thrust plate 81.

Figure 3:
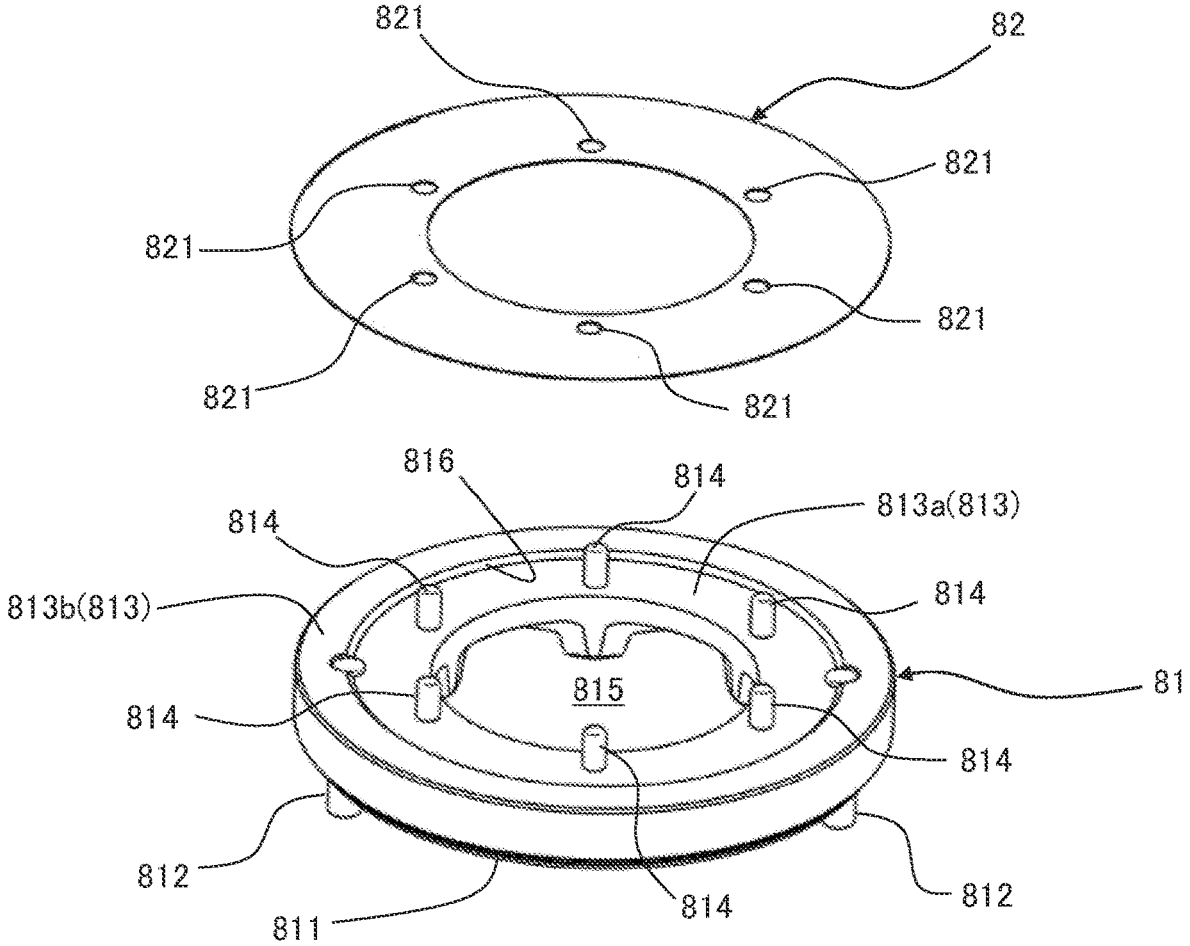
FIG. 3 is a perspective view illustrating a thrust plate and a thrust sheet.
Figure 4:
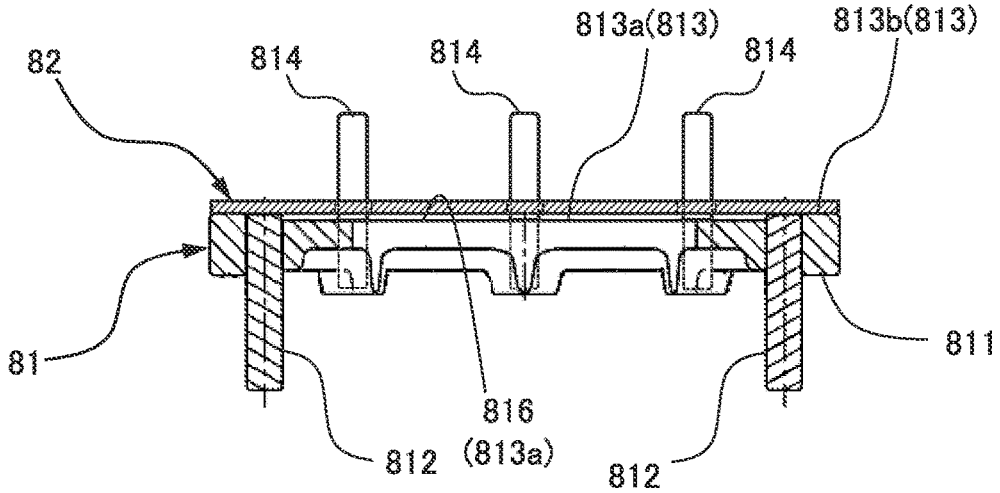
FIG. 4 is a cross-sectional view of the thrust plate.
Figure 5:
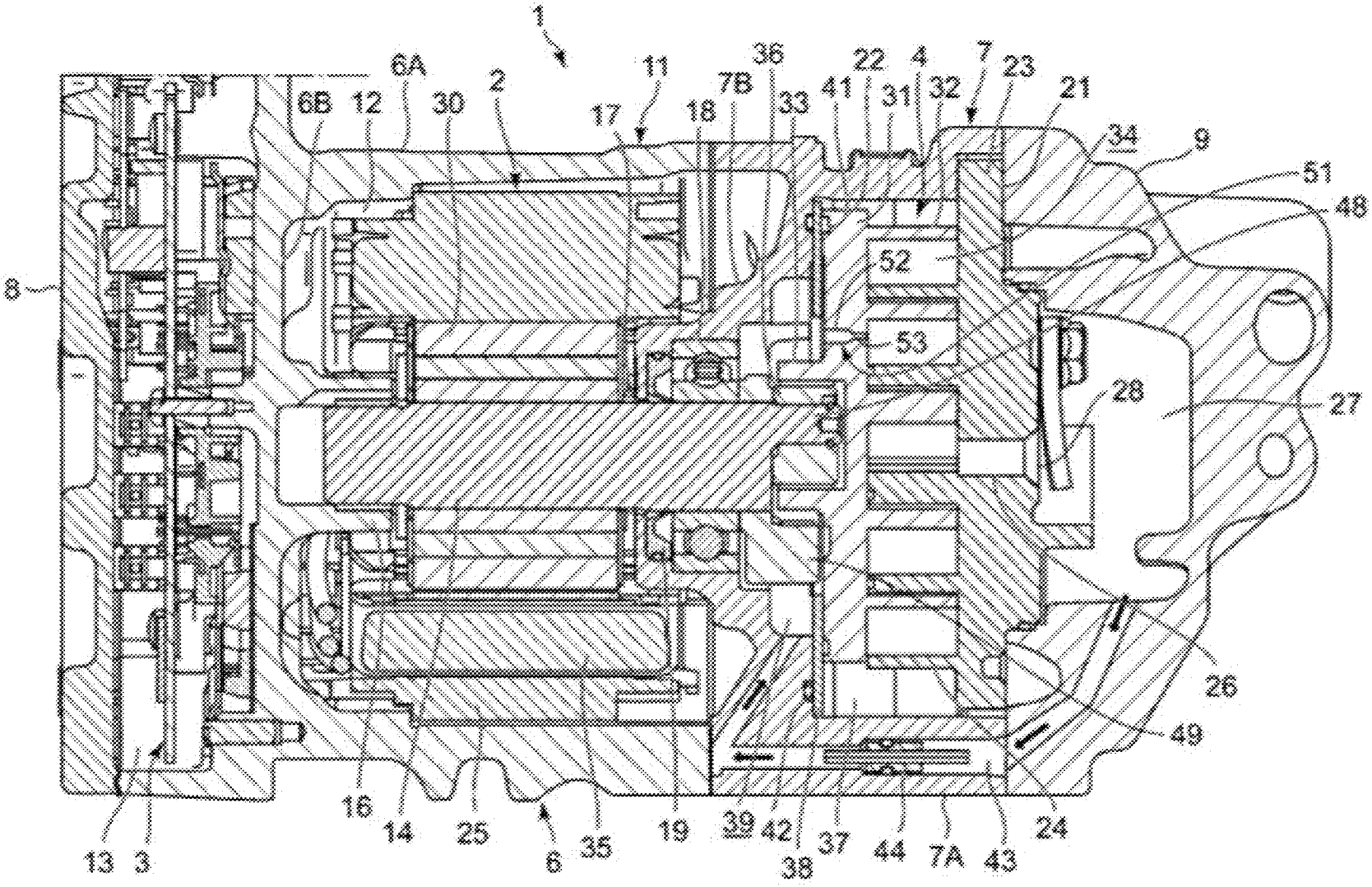
(PRIOR ART) FIG.5
FIG. 5 is a drawing (cross-sectional view) illustrating an example of a conventional scroll compressor.
Figure 6:
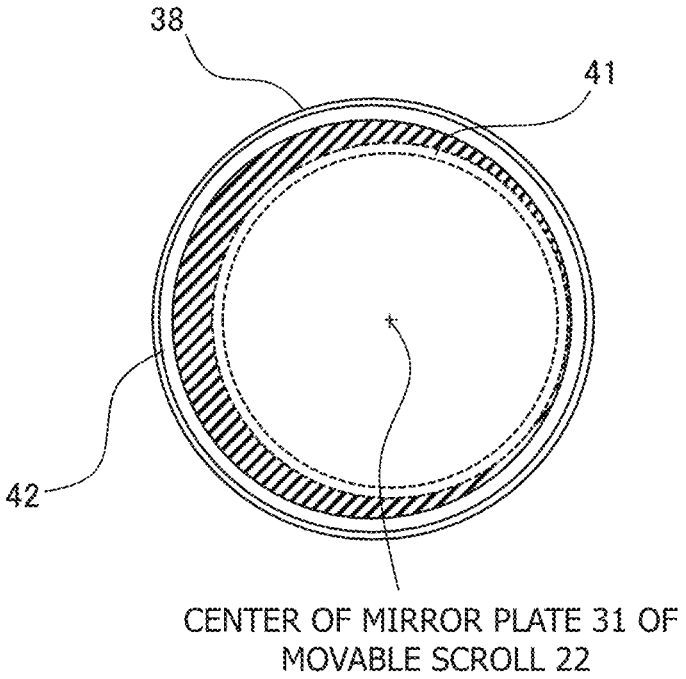
(PRIOR ART) FIG.6
FIG. 6 is a drawing for explaining a back pressure load in the conventional scroll compressor.

FIG. 3 is a perspective view illustrating the thrust plate 81 and the thrust sheet 82. FIG. 4 is a cross-sectional view of the thrust plate 81 and the thrust sheet 82.

As illustrated in FIGS. 2 to 4, the thrust plate 81 includes two positioning pins 812 each protruding from its opposing surface 237 side surface 811 and six rotation preventing pins 814 protruding from its orbiting scroll 52 side surface 813. The thrust sheet 82 has six insertion holes 821 each corresponding to one of the six rotation preventing pins 814.

In the present embodiment, the two positioning pins 812 are each press-fitted and fixed into corresponding one of two first press-fitting holes formed on the thrust plate 81 at opposite sides of a hollow portion 815, such that each of the two positioning pins 812 partly protrude from the opposing surface 237 side surface 811 of the thrust plate 81.

In addition, the two positioning pins 812 are each inserted, so as to be movable in the axial direction, into each of two corresponding positioning holes 238 formed on the opposing surface 237 of the second partition wall 232 (preferably, one is formed into a circular hole and the other is formed into an elongated hole).

The two positioning pins 812 are each inserted into the corresponding one of the two positioning holes 238 formed on the opposing surface 237 of the second partition wall 232 and the thrust plate 81 is thereby attached to the opposing surface 237 of the second partition wall 232 so as to be movable in the axial direction of the drive shaft 30 while being positioned so as not to rotate.

The thrust plate 81 has on its orbiting scroll 52 side surface 813 a circular concave portion 816 that is concentric with the thrust plate 81. In other words, in the present embodiment, the orbiting scroll 52 side surface 813 of the thrust plate 81 is composed of a first annular surface 813*a* consisting of a bottom surface of the circular concave portion 816 and a second annular surface 813*b* that is positioned one step higher than the first annular surface 813*a* and radially outside the circular concave portion 816. When viewed from the axial direction of the drive shaft 30, the circular concave portion 816 is formed to be positioned inward of an area in which, during the orbiting motion of the orbiting scroll 52, the first sealing member 83 slides on the orbiting scroll 52 side surface of the thrust sheet 82, i.e., inward from (an outline of) a sliding area in which the first sealing member 83 slides with respect to the thrust sheet 82 along with the orbiting motion of the orbiting scroll 52. Also, in the present embodiment, the circular concave portion 816 is formed to have a diameter less than the outer diameter of the first sealing member 83. However, the present invention is not limited to this example. The circular concave portion 816 may be formed to have a diameter substantially equal to the outer diameter of the first sealing member 83.

The six rotation preventing pins 814 are each press-fitted into corresponding one of six second press-fitting holes formed circumferentially at regular intervals such that each of the rotation preventing pins 814 partly protrudes from the orbiting scroll 52 side surface 813 of the thrust plate 81. Specifically, in the present embodiment, the six second press-fitting holes are formed circumferentially at regular intervals on the first annular surface 813*a* consisting of the bottom surface of the circular concave portion 816. The six rotation preventing pins 814 are each press-fitted into the corresponding one of the six press-fitting holes formed on the first annular surface 813*a* so as to protrude relative to the second annular surface 813*b*.

The six rotation preventing pins 814 are each inserted into corresponding one of six insertion holes 821 formed on the thrust sheet 82 to pass through the thrust sheet 82 and are each loosely fitted inside corresponding one of six circular holes 524 (in FIGS. 1 and 2, only one of them is shown) formed at regular intervals surrounding the cylindrical portion 523 on the back surface of the orbiting base plate 521 of the orbiting scroll 52.

The six rotation preventing pins 814 are each inserted into the corresponding one of the six insertion holes 821 of the thrust sheet 82 and the thrust sheet 82 is thereby attached to the orbiting scroll 52 side surface 813 (second annular surface 813*b*) while being prevented from relatively rotating with respect to the thrust plate 81. Here, due to an inner space of the circular concave portion 816, i.e., due to a step between the second annular surface 813*b* and the first annular surface 813*a*, an allowance space to allow the inner circumferential portion of the thrust sheet 82 to be elastically deformed is formed between the thrust plate 81 and the thrust sheet 82. Moreover, the six rotation preventing pins 814 are each loosely fitted into the corresponding one of the six circular holes 524 formed on the back surface of the orbiting scroll 521, thereby preventing the rotation of the orbiting scroll 52. Here, at least three rotation preventing pins 814 (and circular holes 524) are necessary and the number of the rotation preventing pins 811 (and circular holes 524) may be set as desired.

Referring back to FIG. 1, the scroll compressor 10 includes an intake chamber H1 into which a low-pressure gaseous refrigerant flows, a compression chamber H2 in which the low-pressure gaseous refrigerant is compressed, a discharge chamber H3 into which the gaseous refrigerant compressed in the compression chamber H2 is discharged, a gas-liquid separation chamber H4 in which lubricant is separated from the gaseous refrigerant compressed in the compression chamber H2, and a back pressure chamber H5 formed on the back surface side of the orbiting base plate 521 of the orbiting scroll 52.

The intake chamber H1 is enclosed and formed by the first peripheral wall 211 of the front housing 21, the first partition wall 212 of the front housing 21, the second peripheral wall 231 of the center housing 23, and the second partition wall 232 of the center housing 23. That is, in the present embodiment, the intake chamber H1 is formed by the motor storage space of the front housing 21 and the connection space of the center housing 23. The first peripheral wall 211 has an intake port P1. The intake port P1 is connected to (the low-pressure side of) the refrigerant circuit via, for example, a connection pipe (not shown). Thus, a low-pressure refrigerant flows from the refrigerant circuit into the intake chamber H1 via the intake port P1. In addition, the center housing 23 includes a refrigerant passage L1 for guiding the low-pressure gaseous refrigerant in the intake chamber H1 to a space H6 radially outside the scroll unit 50.

The compression chamber H2 is formed between the fixed scroll 51 and the orbiting scroll 52. Specifically, in the scroll unit 50, when the orbiting scroll 52 orbits with respect to the fixed scroll 51, the orbiting spiral wall 522 contacts the fixed spiral wall 512, and a crescent-shaped closed space is formed on the radially outer side by the fixed base plate 511, the fixed spiral wall 512, the orbiting base plate 521, and the orbiting spiral wall 522. The formed crescent-shaped closed space moves radially inward, and the volume of the crescent-shaped closed space gradually decreases. The crescent-shaped closed space formed between the fixed scroll 51 and the orbiting scroll 52 forms the compression chamber H2. The scroll unit 50 is configured such that the low-pressure gaseous refrigerant is drawn from the space H6 and compressed when the crescent-shaped closed space (i.e., the compression chamber H2) is formed.

The discharge chamber H3 is enclosed and formed by the third peripheral wall 241 of the rear housing 24, the bottom wall 242 of the rear housing 24, and the fixed base plate 511 of the fixed scroll 51. That is, the inside of the third peripheral wall 241 of the rear housing 24 forms the discharge chamber H3. A discharge hole L2 is formed in a radially in the middle of the fixed base plate 511 of the fixed scroll 51 so that the compression chamber H2 moved to the innermost position communicates with the discharge chamber H3. With this configuration, the gaseous refrigerant compressed in the compression chamber H2 of the scroll unit 50 is discharged into the discharge chamber H3 via the discharge hole L2. A check valve (reed valve) 95 is provided for the discharge hole L2 to allow the flow of the gaseous refrigerant from the compression chamber H2 to the discharge chamber H3 and prevent the flow of the gaseous refrigerant from the discharge chamber H3 to the compression chamber H2.

The gas-liquid separation chamber H4 is provided in the rear housing 24. Specifically, in the present embodiment, the gas-liquid separation chamber H4 is formed as a cylindrical space that extends downward from the outer peripheral surface to the inside along the bottom wall 242 of the rear housing 24. The discharge chamber H3 communicates with the gas-liquid separation chamber H4 via a communicating hole L3. An oil separator 100, which separates a lubricant included in the gaseous refrigerant, is disposed in the gas-liquid separation chamber H4. Although a centrifugal oil separator is used in the present embodiment, any other type of oil separator may also be used. A discharge port P2 is provided above the oil separator 100 in the gas-liquid separation chamber H4. The discharge port P2 is connected to (the high-pressure side of) the refrigerant circuit via, for example, a connecting pipe (not shown).

The back pressure chamber H5 is formed between the orbiting base plate 521 of the orbiting scroll 52 and the second partition wall 232 of the center housing 23. In the present embodiment, the back pressure chamber H5 includes the internal space of the hollow projection portion 233 of the second partition wall 232. The back pressure chamber H5 is partitioned from the space H6, which serves as a pressure area of the intake chamber H1 (suction pressure area) and is radially outside the scroll unit 50, by the thrust plate 81, thrust sheet 82, the first sealing member 83, and the second sealing member 84.

A lubricant passage L4 is formed in the center housing 23 and the rear housing 24 to connect the discharge chamber H3 and the back pressure chamber H5 and to connect the gas-liquid separation chamber H4 and the back pressure chamber H5. An orifice (a restriction portion) OL is disposed midway of the lubricant passage L4. The back pressure chamber H5 communicates with the intake chamber H1 via a small gap between the inner peripheral surface of the shaft insertion hole 234 and the outer peripheral surface of the drive shaft 30. However, the present invention is not limited to this example. A configuration may be adopted in which the gap between the inner peripheral surface of the shaft insertion hole 234 and the outer peripheral surface of the drive shaft 30 is sealed and the back pressure chamber H5 communicates with the intake chamber H1 via a pressure release path in the middle of which an orifice or a back pressure control valve is provided.

Next, the operation of the scroll compressor 10 is described.

When the inverter 60 supplies power to the electric motor 40, the electric motor 40 rotates the drive shaft 30, the rotation of the drive shaft 30 is transmitted to the orbiting scroll 52 via the crank mechanism 70, and the orbiting scroll 52 orbits with respect to the fixed scroll 51. As a result, a low-pressure gaseous refrigerant from the refrigerant circuit flows into the intake chamber H1 via the intake port P1, passes through the refrigerant path L1 and reaches the space H6. After being guided to the space H6, the low-pressure gaseous refrigerant is drawn into and is compressed in the compression chamber H2 formed between the fixed scroll 51 and the orbiting scroll 52. The gaseous refrigerant compressed in the compression chamber H2 (high-pressure gaseous refrigerant) is discharged into the discharge chamber H3 via the discharge hole L2 (and the check valve 95) and then flows into the gas-liquid separation chamber H4 via the communication hole L3. The lubricant contained in the gaseous refrigerant that flowed into the gas-liquid separation chamber H4 is separated by the oil separator 100. After the lubricant is separated by the oil separator 100, the gaseous refrigerant is sent to the refrigerant circuit via the discharge port P2. On the other hand, the lubricant separated from the gaseous refrigerant by the oil separator 100 is accumulated at the bottom of the gas-liquid separation chamber H4. Also, a part of the lubricant included in the gaseous refrigerant discharged into the discharge chamber H3 is accumulated at the bottom of the discharge chamber H3.

During operation of the scroll compressor 10, a thrust load in a direction of separating the orbiting scroll 52 from the fixed scroll 51 acts on the orbiting scroll 52 due to a compression reaction force. The thrust load acting on the orbiting scroll 52 is transmitted to the opposing surface 237 of the second partition wall 232 via the thrust sheet 82 and the thrust plate 81. In other words, the opposing surface 237 of the second partition wall 232 is configured to receive, via the thrust sheet 82 and the thrust plate 81, the thrust load acting on the orbiting scroll 52 due to the compression reaction force. Thus, in the present embodiment, the opposing surface 237 of the second partition wall 232 serves as a "thrust receiving part" of the present invention.

The back pressure chamber H5 communicates with the discharge chamber H3 and the gas-liquid separation chamber H4 via the lubricant passage L4 and communicates with the intake chamber H1 via the small gap between the inner peripheral surface of the shaft insertion hole 234 and the outer peripheral surface of drive shaft 30. Thus, the lubricant (and a part of the gaseous refrigerant) accumulated at the bottom of the discharge chamber H3 and/or the bottom of the gas-liquid separation chamber H4 are supplied to the back pressure chamber H5 via the lubricant passage L4 while being decompressed by the orifice OL. In addition, the back pressure chamber H5 communicates with the intake chamber H1 via the small gap, and thus, the lubricant (and/or the gaseous refrigerant) that flows from the back pressure chamber H5 into the intake chamber H1 is restricted. As a result, the pressure in the back pressure chamber H5 is maintained at a medium pressure Pm between a pressure Ps in the intake chamber H1 and a pressure Pd in the discharge chamber H3 (i.e., a pressure in the gas-liquid separation chamber 114). Due to this medium pressure (back pressure) Pm, the back pressure load in the direction of pressing the orbiting scroll 52 against the fixed scroll 51 acts on the thrust plate 81 and the orbiting scroll 52. That is, the back pressure chamber H5 applies the back pressure load in the direction of pressing the orbiting scroll 52 against the fixed scroll 51 to the thrust plate 81 and the orbiting scroll 52.

The orbiting scroll 52 is pushed by the back pressure load acting mainly on the thrust plate 81 and the orbiting scroll 52 and is pressed toward the fixed scroll 51 against the compression reaction force. As a result, contacts can be maintained between the fixed spiral wall 512 and the orbiting base plate 521 and between the orbiting spiral wall 521 and the fixed base plate 511, thereby preventing the reduction in efficiency of compression of the gaseous refrigerant in the compression chamber H2.

As described above, in the scroll compressor 10 according to the embodiment, the annular thrust plate 81 and the annular thrust sheet 82 are provided on the back surface side of the orbiting base plate 521 of the orbiting scroll 52, more specifically, between the opposing surface (thrust receiving part) 237 of the second partition wall 232 and the orbiting base plate 521 of the orbiting scroll 52. The thrust plate 81 is formed to have a diameter greater than that of the orbiting base plate 521. The thrust sheet 82 is provided between the orbiting base plate 512 and the thrust plate 82, is formed to have a diameter substantially equal to that of the thrust plate 82, and is capable of being elastically deformed in the axial direction of the drive shaft 30. The annular first sealing member 83 attached to the peripheral edge of the back surface of the orbiting base plate 521 and having slidability seals between the orbiting base plate 521 and the thrust sheet 82. The second sealing member 84 attached to the opposing surface (thrust receiving part) 234 seals between the opposing surface (thrust receiving part) 234 of the second partition wall 232 and the thrust plate 81. The second sealing member 84 has elasticity and is formed to have the diameter greater than that of the first sealing member 83. The back pressure chamber H5 is partitioned from the space H6 (suction pressure area) near an outer end portion of the scroll unit 50 by the thrust plate 81, the thrust sheet 82, the first sealing member 83, and the second sealing member 84. The circular concave portion 816 is formed on the thrust sheet 82 side surface of the thrust plate 81. When viewed from the axial direction of the drive shaft 30, the circular concave portion 816 is positioned inward from (the outline of) the sliding area in which the first sealing member 83 slides with respect to the thrust sheet 82 along with the orbiting motion of the orbiting scroll 52.

The scroll compressor 10 according to the embodiment provides effects as described below.

Formed on the thrust sheet 82 side surface of the thrust plate 81 is the circular concave portion 816. Due to (the inner space of) the circular concave portion 816, the allowance space to allow the thrust sheet 82 to be elastically deformed is formed between the thrust plate 81 and the thrust sheet 82. Accordingly, even if the orbiting scroll 52 is pressed against the fixed scroll 52 in a tilted state, the thrust sheet 81 is elastically deformed in the circular concave portion 816. This can prevent the orbiting spiral wall 521 of the orbiting scroll 52 from contacting the fixed base plate 511 of the fixed scroll 51 with excessive contact force. As a result, the surface pressure acting on the tip of the winding terminal portion of the orbiting spiral wall 522 of the orbiting scroll 52 can be reduced, and thereby wear and damage of the tip of the winding terminal portion of the orbiting spiral wall 522 of the orbiting scroll 52 can be prevented.

Also, the thrust plate 81 is attached to the opposing surface (thrust receiving part) 237 of the second partition wall 232 so as to be movable in the axial direction of the drive shaft 30 and the second sealing member 84 seals between the opposing surface (thrust receiving part) 237 and the thrust plate 81. That is, the second sealing member 84 is pressed to be elastically deformed between the thrust plate 81 and the opposing surface 237 of the second partition wall 232 and can thereby press, by its elastic restoration force, the thrust plate 81 in the direction of pressing the orbiting scroll 52 against the fixed scroll 51. Accordingly, contact can be maintained between the orbiting spiral wall 521 and the fixed base plate 511 while the orbiting spiral wall 521 is prevented from contacting the fixed base plate 511 with excessive contact force. As a result of this as well, the surface pressure acting on the tip of the winding terminal portion of the orbiting spiral wall 522 of the orbiting scroll 52 can be reduced, and thereby, wear and damage of the tip of the winding terminal portion of the orbiting spiral wall 522 of the orbiting scroll 52 can be prevented.

Moreover, the thrust plate 81 has two positioning pins 812 each protruding from the opposing surface (thrust receiving part) 237 side surface 811. The two positioning pins 812 are each configured to be inserted into the corresponding one of the two positioning holes 238 formed on the opposing surface 237 so as to be movable in the axial direction of the drive shaft 30, thereby positioning the thrust plate 81 with respect to the opposing surface (thrust receiving part) 237 such that the thrust plate 81 is prevented from rotating. This enables the thrust plate 81 to move in the axial direction of the drive shaft 30 and to be easily assembled to the opposing surface (thrust receiving part) 237.

Moreover, the thrust plate 81 has a plurality of (six) rotation preventing pins 814 each protruding from the orbiting scroll 52 side surface 813. The plurality of rotation preventing pins 814 are each configured to extend passing through the thrust sheet 82 and to be loosely fit into the corresponding one of the circular holes 524 formed on the back surface of the orbiting base plate 521 of the orbiting scroll 52 to prevent rotation of the orbiting scroll 52. Accordingly, positional deviation and rotation of the thrust sheet 82 as well as rotation of the revolving orbiting scroll 52 can be prevented.

A preferred embodiment of the present invention is described above. However, the present invention is not limited to the above-described embodiment, and clearly, the embodiment may be further modified and changed based on the technical idea of the present invention.

REFERENCE SYMBOL LIST

10 scroll compressor
30 drive shaft
50 scroll unit
51 fixed scroll
52 orbiting scroll
81 thrust plate (plate member)
82 thrust sheet (sheet member)
83 first sealing member
84 second sealing member
237 opposing surface (thrust receiving part)
511 fixed base plate
512 fixed spiral wall
521 orbiting base plate
522 orbiting spiral wall
812 positioning pin
814 rotation preventing pin
816 circular concave portion
H2 compression chamber
H5 back pressure chamber

The invention claimed is:

1. A scroll compressor comprising:

a drive shaft;

a fixed scroll including a fixed base plate and a fixed spiral wall erected on the fixed base plate; and an orbiting scroll including an orbiting base plate and an orbiting spiral wall that is erected on the orbiting base plate and meshes with the fixed spiral wall, wherein the scroll compressor is configured such that a volume of a compression chamber formed between the fixed scroll and the orbiting scroll changes and a fluid taken into the compression chamber is thereby compressed when the orbiting scroll orbits with respect to the fixed scroll along with a rotation of the drive shaft, wherein the scroll compressor further comprises an annular plate member that is provided on a back surface side of the orbiting base plate of the orbiting scroll and has a diameter greater than a diameter of the orbiting scroll, an annular sheet member that is provided between the back surface of the orbiting base plate of the orbiting scroll and the annular plate member, has a diameter substantially equal to the diameter of the annular plate member, and is capable of being elastically deformed, an annular first sealing member attached to a peripheral edge of the back surface of the orbiting base plate of the orbiting scroll, of which a tip slidably contacts the annular sheet member, a thrust receiving part that receives, via the annular sheet member and the annular plate member, a thrust load that acts on the orbiting scroll due to a compression reaction force, an annular second sealing member that is formed to have a diameter greater than a diameter of the first sealing member, attached to one of a surface of the annular plate member on the thrust receiving part side and the thrust receiving part, and of which a tip contacts the other one of the surface of the annular plate member on the thrust receiving part side and the thrust receiving part, and a back pressure chamber that is partitioned from a suction pressure area by the annular plate member, the annular sheet member, the first sealing member, and the second sealing member and applies a back pressure load that presses the orbiting scroll against the fixed scroll due to the annular sheet member contacting the orbiting scroll, and wherein a circular concave portion is formed on a surface of the annular plate member on the annular sheet member side.

2. The scroll compressor according to claim 1, wherein, when viewed from an axial direction of the drive shaft, the circular concave portion is formed to be positioned inward of a sliding area in which the first sealing member slides with respect to the annular sheet member along with an orbiting motion of the orbiting scroll.

3. The scroll compressor according to claim 2, wherein the circular concave portion is formed to have a diameter substantially equal to or less than an outer diameter of the first sealing member.

4. The scroll compressor according to claim 2, wherein the annular plate member is provided so as to be movable in the axial direction of the drive shaft, and wherein the second sealing member has elasticity and is pressed to be elastically deformed between the annular plate member and the thrust receiving part.

5. The scroll compressor according to claim 1, wherein the circular concave portion is formed to have a diameter substantially equal to or less than an outer diameter of the first sealing member.

6. The scroll compressor according to claim 5, wherein the annular plate member is provided so as to be movable in the axial direction of the drive shaft, and wherein the second sealing member has elasticity and is pressed to be elastically deformed between the annular plate member and the thrust receiving part.

7. The scroll compressor according to claim 1, wherein the annular plate member is provided so as to be movable in the axial direction of the drive shaft, and wherein the second sealing member has elasticity and is pressed to be elastically deformed between the annular plate member and the thrust receiving part.

8. The scroll compressor according to claim 7, wherein the annular plate member has two positioning pins each protruding from a surface of the annular plate member on the thrust receiving part side, and wherein the two positioning pins are each configured to be inserted into a corresponding one of two positioning holes formed on the thrust receiving part so as to be movable in the axial direction of the drive shaft, thereby positioning the annular plate member with respect to the thrust receiving part such that the annular plate member is prevented from rotating.

9. The scroll compressor according to claim 8, wherein the annular plate member has a plurality of rotation preventing pins each protruding from a surface of the annular plate member on the orbiting scroll side, and wherein the plurality of rotation preventing pins are each configured to extend passing through the annular sheet member and to be loosely fitted into a corresponding one of circular holes formed on the back surface of the orbiting base plate of the orbiting scroll to prevent rotation of the orbiting scroll.

10. The scroll compressor according to claim 7, wherein the annular plate member has a plurality of rotation preventing pins each protruding from a surface of the annular plate member on the orbiting scroll side, and wherein the plurality of rotation preventing pins are each configured to extend passing through the annular sheet member and to be loosely fitted into a corresponding one of circular holes formed on the back surface of the orbiting base plate of the orbiting scroll to prevent rotation of the orbiting scroll.

* * * * *